US008079339B2

(12) United States Patent
Smith

(10) Patent No.: US 8,079,339 B2
(45) Date of Patent: Dec. 20, 2011

(54) RECIPROCABLE MEMBER WITH ANTI-FLOAT ARRANGEMENT

(75) Inventor: Edward M. Smith, Berkeley Springs, WV (US)

(73) Assignee: Mack Trucks, Inc., Greensboro, NC (US)

( * ) Notice: Subject to any disclaimer, the term of this patent is extended or adjusted under 35 U.S.C. 154(b) by 337 days.

(21) Appl. No.: 12/303,991

(22) PCT Filed: Jul. 10, 2006

(86) PCT No.: PCT/US2006/026592

§ 371 (c)(1),
(2), (4) Date: Dec. 9, 2008

(87) PCT Pub. No.: WO2008/008054

PCT Pub. Date: Jan. 17, 2008

(65) Prior Publication Data

US 2010/0224156 A1 Sep. 9, 2010

(51) Int. Cl.
*F01L 3/10* (2006.01)

(52) U.S. Cl. ..... 123/90.65; 123/90.67; 123/90.16

(58) Field of Classification Search ..... 123/90.65, 123/90.67, 90.16

See application file for complete search history.

(56) References Cited

U.S. PATENT DOCUMENTS

| | | | | |
|---|---|---|---|---|
| 2,342,003 | A | 2/1944 | Meyer | |
| 4,446,825 | A * | 5/1984 | Giardini et al. | 123/90.65 |
| 4,938,179 | A | 7/1990 | Kawamura | |
| 5,558,054 | A | 9/1996 | Ariga et al. | |
| 5,664,531 | A | 9/1997 | Kim | |
| 5,743,225 | A * | 4/1998 | Sakurai | 123/90.65 |
| 6,113,011 | A | 9/2000 | Potz et al. | |
| 2003/0200954 | A1 | 10/2003 | Zsoldos et al. | |

FOREIGN PATENT DOCUMENTS

| | | | |
|---|---|---|---|
| DE | 920695 | C | 11/1954 |
| DE | 3529768 | A1 | 2/1987 |
| EP | 0269587 | A1 | 6/1988 |
| EP | 0992657 | A1 | 4/2000 |

OTHER PUBLICATIONS

Abstract in English for DE 3529768; Feb. 1987.*

International Search Report for corresponding International Application PCT/US2006/026592.

Supplementary European Search Report for corresponding application EP 06 78 6670.

Official Action from corresponding European Application 06780670.7.

* cited by examiner

*Primary Examiner* — Zelalem Eshete
(74) *Attorney, Agent, or Firm* — WRB-IP LLP

(57) ABSTRACT

An exhaust valve arrangement includes a cylinder having a top end, an exhaust conduit connected to the cylinder by an opening in the top end of the cylinder, the opening comprising a valve seat, a valve member comprising a valve stem and a valve head on the valve stem, the valve member being movable between a closed position in which the valve head is received in the valve seat and an open position in which the valve head is spaced from the valve seat, and a resilient member arranged to urge the valve member to a closed position. A piston is mounted relative to the valve stem, the piston being disposed in a second cylinder in flow communication with the exhaust conduit and arranged such that a change in pressure in the exhaust conduit changes a degree of compression of the resilient member.

13 Claims, 2 Drawing Sheets

RECIPROCABLE MEMBER WITH ANTI-FLOAT ARRANGEMENT

BACKGROUND AND SUMMARY

The present invention relates to reciprocable members and, more particularly, to reciprocable members such as valves with an anti-float arrangement.

Exhaust manifold pressure has historically been one of the major design constraints for engine brakes that limit engine braking power. This is especially the case on single-valve actuation engine brakes, where only one exhaust valve spring is available to control exhaust valve motion during engine braking. In combination with valvetrain acceleration in the 'closing' direction, high exhaust manifold pressure during engine braking can cause the valve to 'float', or not follow the cam profile over the closing flank of the valve lift profile, producing the potential of piston-to-valve contact, valve seat wear due to uncontrolled valve closing, and valvetrain damage due to impact stresses. Valve float can generally be thought of as meaning unintended, uncontrolled motion of the valve. In extreme cases, high exhaust manifold pressure spikes have been known to 'blow' the exhaust valves off their seats during the intake stroke, causing unintended valve lift and, again, uncontrolled valve seating. This invention is for the purpose of reducing or eliminating the influence of exhaust manifold pressure on valve float.

Problems with valve float are not limited to exhaust valves. In reciprocating members, generally, where different pressures might be present on different sides of a valve arranged to be alternately seated in and displaced from a valve seat, it occasionally happens that the valve is held in an open position or otherwise fails to seat properly in the valve seat (or, in some situations, is forced closed by gas pressure when it is intended to be open) because the pressure differential holds the valve in an open position against some mechanical structure such as a spring arrangement that would ordinarily urge the valve head to the closed position in the valve seat. Whatever the application, valve float can be problematic.

Solutions to problems with valve float such as valve heads being struck by pistons include desmodromic valves that are positively closed by a cam and leverage system. Disadvantages to such systems include their high service costs and frequent service requirements needed as the result of high precision requirements.

It is desirable to provide an exhaust valve arrangement that reduces problems with valve float. It is also desirable to provide a valve arrangement for use in other applications that can reduce problems with valve float. It is also desirable to provide a valve arrangement that can reduce problems with valve float with minimal extra cost and requiring minimal additional servicing.

In accordance with a first aspect of the present invention, a valve arrangement comprises a valve member comprising a valve stem and a valve head having a first and a second side on the valve stem, a wall between a first space and a second space, the first and second sides of the valve head facing the first and second spaces, respectively, an opening in the wall defining a valve seat, the valve member being movable between an open position in which the valve head is disposed in one of the first space and the second space and a closed position in which the valve head is disposed in the valves seat, and a piston mounted relative to the valve stem, the piston being disposed in a cylinder in flow communication with the first space.

In accordance with another aspect of the present invention, a spring loaded piston arrangement comprises a cylinder, a piston disposed in the cylinder, the piston being mounted on a stem, the stem having a spring retainer, and a resilient member in contact with the spring retainer and arranged to urge the spring retainer away from the piston.

In accordance with yet another aspect of the present invention, an exhaust valve arrangement comprises a cylinder having a top end, an exhaust conduit connected to the cylinder by an opening in the top end of the cylinder, the opening comprising a valve seat, a valve member comprising a valve stem and a valve head on the valve stem, the valve member being movable between a closed position in which the valve head is received in the valve seat and an open position in which the valve head is spaced from the valve seat, and a resilient member arranged to urge the valve member to a closed position. A piston is mounted relative to the valve stem, the piston being disposed in a second cylinder in flow communication with the exhaust conduit and arranged such that a change in pressure in the exhaust conduit changes a degree of compression of the resilient member.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
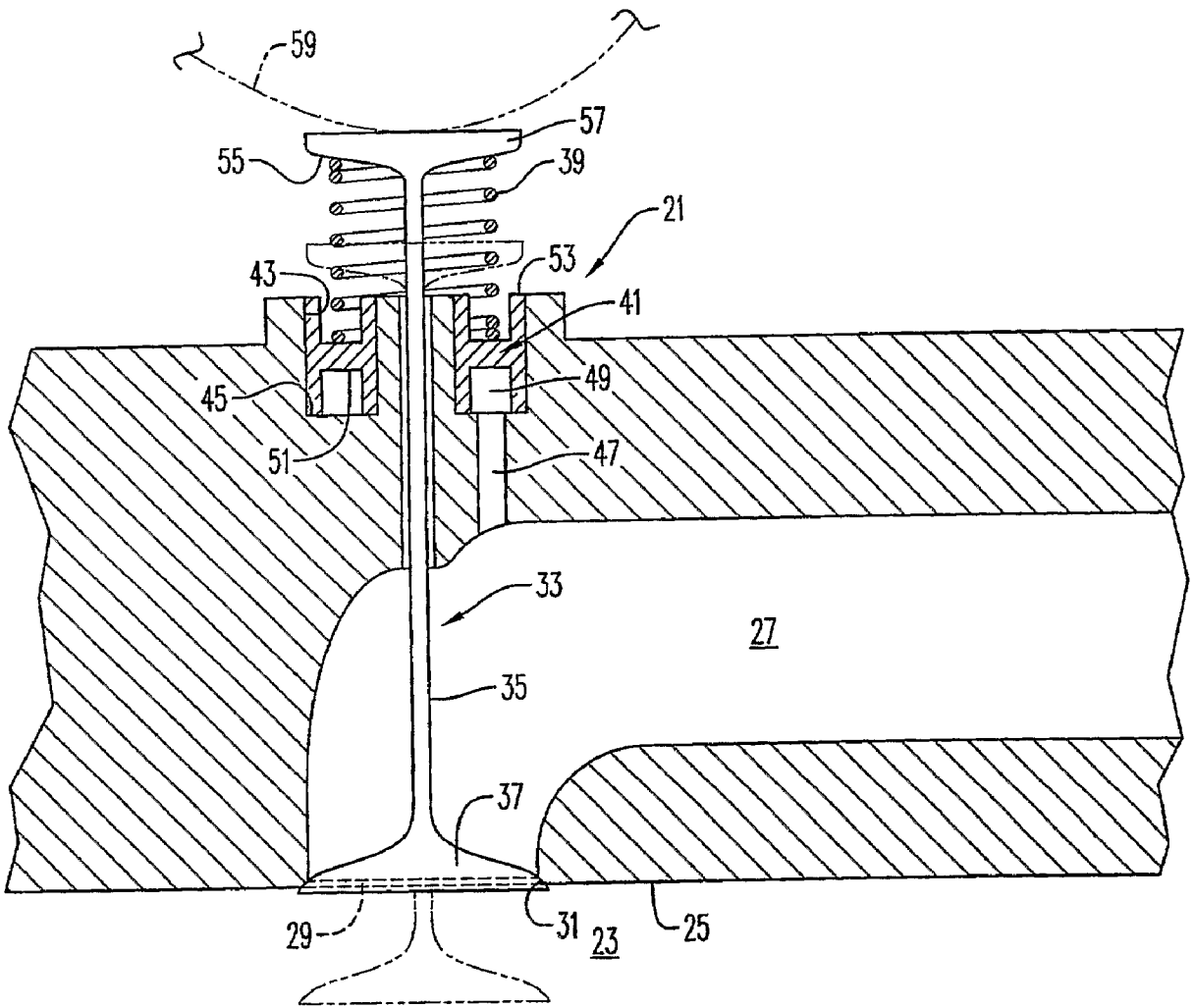
FIG. 1 is a schematic, side, partially cross-sectional view of an exhaust valve arrangement according to an embodiment of the present invention.

An exhaust valve arrangement 21 with an anti-float arrangement according to an embodiment of the present invention is shown in FIG. 1. While use of the present invention in conjunction with an exhaust valve arrangement is a possible application of the invention, it will be appreciated that the present invention has applications in other areas involving reciprocating members, as well. The exhaust valve arrangement 21 comprises a cylinder 23 having a top end 25. An exhaust conduit 27 is connected to the cylinder 23 by an opening 29 in the top end 25 of the cylinder. The opening 29 comprises a valve seat 31.

A valve member 33 comprising a valve stem 35 and a valve head 37 on the valve stem. The valve member 33 is movable between a closed position in which the valve head 37 is received in the valve seat 31 and an open position (shown in phantom) in which the valve head is spaced from the valve seat.

In the illustrated embodiment, the valve member 33 is ordinarily urged to the closed position. It will be appreciated, however, that the present invention has applications wherein a valve member might be ordinarily urged to an open position, instead. For purposes of discussion, an embodiment wherein the valve member 33 is urged to the closed position will be described.

Substantially any suitable resilient member 39 may be arranged to urge the valve member 33 to the closed position, such as a spring, such as a coil spring (as illustrated) or a leaf spring, a compressible rubber member, a piston member disposed in a cylinder containing compressible fluid, and the like. For purposes of discussion, an embodiment wherein the valve member 33 is urged to the closed position by a resilient member such as a coil spring shall be described, it being understood that other structures might also be suitable for urging the valve member to the closed position.

A piston 41 is mounted relative to the valve stem 35, usually on or around the valve stem, although the piston may be located elsewhere, such as alongside the valve stem, among other possibilities. The piston 41 is disposed in a second cylinder 43 in flow communication with the exhaust conduit 27 and is arranged such that a change in pressure in the exhaust conduit changes a degree of compression of the resilient member 39. In the embodiment of FIG. 1, the piston 41 is slidably mounted relative to the valve stem 35 in a second cylinder 43 defining, at a bottom end 45 thereof, a stop.

When pressure in the exhaust conduit 27 increases, the valve head 37 may tend to float or incompletely be seated in the valve seat 31. However, because the pressure in a chamber 49 that communicates with the exhaust conduit 27, such as through a passage 47, the chamber being defined in part by the walls of the second cylinder and the first side 51 of the piston 41 also increases as exhaust conduit 27 pressure increases, the exhaust conduit pressure tends to urge the piston upward in the second cylinder 43, thereby tending to compress the resilient member 39 between a second side 53 of the piston 41 and a spring retainer 55 on the valve stem 35. As the piston 41 tends to compress the resilient member 39, the resilient member at the same time tends to release compression and urge the piston 41 back down against the stop (formed in this case by the bottom end 45 of the second cylinder 43). Because compression of the resilient member 39 is released, in the embodiment of FIG. 1, by urging the valve head 37 toward the valve seat, an increase in exhaust conduit pressure ultimately has the effect of drawing the valve head toward the valve seat and tending to overcome any floating of the valve head in the cylinder 23. In the embodiment of FIG. 1, the resilient member 39 is in contact with the piston 41 and the spring retainer 55, however, this need not necessarily be the case and intermediate members may be disposed between the resilient member, the piston, and the spring retainer.

Figure 2:
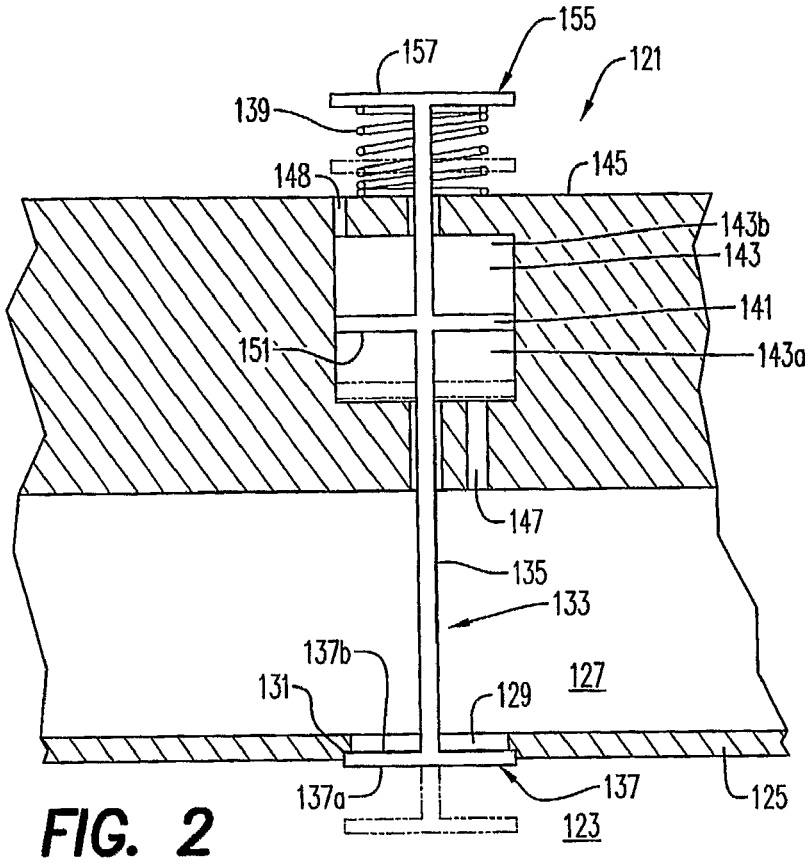
FIG. 2 is a schematic, side, partially cross-sectional view of a valve arrangement according to an embodiment of the present invention.

A more general description of a valve arrangement 121 is provided with reference to FIG. 2. In this embodiment, a valve member 133 comprises a valve stem 135 and a valve head 137 having a first and a second side 137*a* and 137*b*, respectively, on the valve stem. A wall 125 is provided between a first space 123 and a second space 127. The wall 125 may be the top end of a cylinder which may form the first space 123 and an exhaust conduit may form the second space 127, although other applications for the invention exist.

The first and second sides 137*a* and 137*b* of the valve head 137 face the first and second spaces 123 and 127, respectively. An opening 129 in the wall 125 defines a valve seat 131. The valve member 133 is movable between an open position (shown in phantom) in which the valve head 137 is disposed in the first space 123 and a closed position in which the valve head is disposed in the valve seat 131. A piston 141 is mounted relative to the valve stem 135, the piston being disposed in a cylinder 143, a side 143*a* of which is in flow communication with the second space 127 through a passage 147, and a side 143*b* of which is in flow communication with other, usually ambient, conditions through a passage 148.

Figure 3:
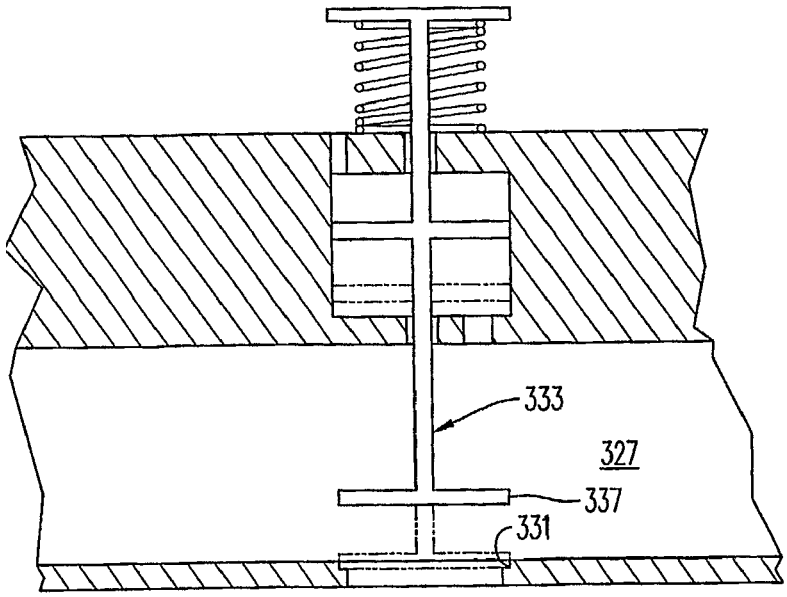
FIG. 3 is a schematic, side, partially cross-sectional view of a valve arrangement according to another embodiment of the present invention.

In another embodiment, seen in FIG. 3, the valve member 333 is movable between an open position in which the valve head 337 is disposed in the second space 327 and a closed position in which the valve head is disposed in the valve seat 331. It will be appreciated that the present invention is adapted for use in connection with a variety of valve configurations and other arrangements other than those specifically described here. A valve configuration such as is shown in FIG. 1 where a piston is slidably mounted relative to the valve stem may require less force to open the valve, as a reciprocating device, such as a cam, that is intended to move the valve stem only has to overcome the force of the pressure in the exhaust conduit 27 acting on the valve head 37 while, in embodiments such as are shown in FIGS. 2 and 3, the reciprocating device will ordinarily have to overcome the force of the pressure in the exhaust conduit or second space 127 or 327 acting on the valve head as well as the force of the pressure in the exhaust conduit or second space acting on the piston.

With respect to the valve arrangement 121 shown in FIG. 2, a resilient member 139 is arranged to urge the valve member 133 to the closed position. In this embodiment, the resilient member 139 does not contact the piston 141 like the resilient member 39 contacts the piston 41 in the embodiment of FIG. 1. In the embodiment of FIG. 2, the resilient member 139 is disposed between a spring retainer 155 on the valve stem 135 and a valve seat surface 145. The piston 141 is non-slidable relative to the valve stem 135 and an increase in pressure in the second space 127 which communicates with a space 143*a* on a first side 151 of the piston 141 tends, together with the resilient member 139, to urge the valve head 137 toward the valve seat 131. The spring retainer 155 can, as in the embodiment of FIG. 1, also comprise a cam surface 157 so that a cam or other device generating reciprocating motion can be used to move the valve member 133 to the open position.

In the embodiment of FIG. 1, the resilient member 39 contacts the piston 41 and the piston is slidably mounted relative to the valve stem 35. The bottom 45 of the second cylinder 43 comprises a stop arranged to stop movement of the piston toward the exhaust conduit 27. The valve arrangement 21 comprises the valve spring retainer 55 on the valve stem 35, and the valve spring retainer can comprise a cam surface 57 that can be contacted by a cam 59 (shown in phantom) or other device generating reciprocating motion. In the embodiment of FIG. 1, the resilient member 39 can be arranged to contact the valve spring retainer 55 to urge the valve member 33 to the closed position. The piston 41 is slidably mounted relative to the valve stem 35. The resilient member 39 is disposed between the piston 41 and the valve spring retainer 55.

The present invention is not limited to applications involving exhaust valves, and may be useful in, for example, so-called double-poppet or pressure balanced type valves. Moreover, the present invention is not limited to applications involving valve configurations and can, for example, be useful in applications where it is desired to provide a reciprocating shaft having a piston arrangement for assisting in urging the shaft in a direction, and not necessarily including a valve head.

Aspects of the valve arrangement according to the present invention can be inexpensive and simple, particularly when compared to desmodromic or other mechanically closed valve arrangements, as they can involve only one additional component on top of a conventional spring-closed valvetrain. Aspects of the invention can also eliminate the need for stiffening the exhaust valve spring, which can increase stress in the spring and induce earlier failure and increase the effort required to operate the mechanism. Stiffening the exhaust valve springs can also cause unfavorable dynamic effects like spring surge. Lightening the valvetrain often can only be done at the cost of valvetrain strength, and only helps when valvetrain inertia is a factor in the valve float, not when the valve is seated. Finally, with aspects of this invention it is theoretically possible to completely counteract the valve opening force caused by exhaust manifold pressure, thus eliminating valve float as a consideration for the exhaust manifold pressure limit.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A valve arrangement, comprising:

a valve member comprising a valve stem and a valve head having a first and a second side on the valve stem;

a wall between a first space and a second space, the first and second sides of the valve head facing the first and second spaces, respectively, an opening in the wall defining a valve seat, the valve member being movable between an open position in which the valve head is disposed in one of the first space and the second space and a closed position in which the valve head is disposed in the valve seat;

a piston mounted relative to the valve stem, the piston being disposed in a cylinder in flow communication with the first space;

a valve spring retainer on the valve stem, the valve spring retainer comprising a cam surface; and a resilient member arranged to contact the valve spring retainer and urge the valve member to the closed position, wherein the resilient member, at all times, is disposed between and separates the piston and the valve spring retainer so that there can be no contact between the piston and the valve spring retainer.

2. The valve arrangement as set forth in claim 1, comprising a resilient member arranged to urge the valve member to one of the closed position and the open position.

3. The valve arrangement as set forth in claim 2, wherein the resilient member contacts the piston.

4. The valve arrangement as set forth in claim 3, wherein the piston is slidably mounted on the valve stem.

5. The valve arrangement as set forth in claim 4, wherein the cylinder comprises a stop arranged to stop movement of the piston toward the first space.

6. The valve arrangement as set forth in claim 1, wherein the piston is slidably mounted on the valve stem.

7. The valve arrangement as set forth in claim 6, wherein the cylinder comprises a stop arranged to stop movement of the piston toward the first space.

8. The valve arrangement as set forth in claim 1, wherein the valve spring retainer comprises a cam surface.

9. The valve arrangement as set forth in claim 1, wherein the piston is always in flow communication with the first space.

10. An exhaust valve arrangement, comprising:

a cylinder having a top end;

an exhaust conduit connected to the cylinder by an opening in the top end of the cylinder, the opening comprising a valve seat;

a valve member comprising a valve stem and a valve head on the valve stem, the valve member being movable between a closed position in which the valve head is received in the valve seat and an open position in which the valve head is spaced from the valve seat, the valve stem having a spring retainer;

a resilient member in contact with the spring retainer and arranged to urge the valve member to a closed position; and a piston mounted relative to the valve stem, the piston being disposed in a second cylinder in flow communication with the exhaust conduit and arranged such that a change in pressure in the exhaust conduit changes a degree of compression of the resilient member, the resilient member being in contact with the piston and, at all times, disposed between and separating the piston and the spring retainer so that there can be no contact between the piston and the valve spring retainer.

11. The exhaust valve arrangement as set forth in claim 10, wherein the piston is slidably mounted on the valve stem.

12. The exhaust valve arrangement as set forth in claim 10, wherein the cylinder comprises a stop arranged to stop movement of the piston toward the exhaust conduit.

13. The exhaust valve arrangement as set forth in claim 10, wherein the piston is always in flow communication with the exhaust conduit.

* * * * *